US007036166B2

(12) United States Patent
Kramer et al.

(10) Patent No.: US 7,036,166 B2
(45) Date of Patent: May 2, 2006

(54) HOSPITAL BED

(75) Inventors: Kenneth L. Kramer, Greensburg, IN (US); David W. Hornbach, Brookville, IN (US); David A. Albersmeyer, Batesville, IN (US); Gerald D. Eckstein, Batesville, IN (US); Michael W. Hamilton, West Harrison, IN (US)

(73) Assignee: Hil-Rom Service, Inc., Wilmington, DE (US)

( * ) Notice: Subject to any disclaimer, the term of this patent is extended or adjusted under 35 U.S.C. 154(b) by 122 days.

(21) Appl. No.: 10/107,777

(22) Filed: Mar. 27, 2002

(65) Prior Publication Data

US 2002/0174487 A1 Nov. 28, 2002

Related U.S. Application Data

(60) Provisional application No. 60/279,063, filed on Mar. 27, 2001.

(51) Int. Cl.
*A61G 7/00* (2006.01)

(52) U.S. Cl. ..... 5/618; 5/617

(58) Field of Classification Search ..... 5/602, 5/617, 618

See application file for complete search history.

(56) References Cited

U.S. PATENT DOCUMENTS

| | | | | | |
|---|---|---|---|---|---|
| 145,452 | A | * | 12/1873 | Robinson | 297/118 |
| 177,511 | A | | 5/1876 | Hofmann | |
| 238,799 | A | | 3/1881 | Morgan | |
| 349,089 | A | * | 9/1886 | Gilbert | 5/618 |
| 415,211 | A | | 11/1889 | Loomis | |
| 544,117 | A | | 8/1895 | Pitkin | |
| 633,264 | A | * | 9/1899 | Huntington | 5/617 |
| 912,214 | A | * | 2/1909 | Ward | 5/618 |
| 942,354 | A | * | 12/1909 | Ryan | 5/634 |
| 971,381 | A | * | 9/1910 | Keller | 5/618 |
| 1,032,743 | A | | 7/1912 | Courtney | |
| 1,055,241 | A | | 3/1913 | Terry | |
| 1,296,451 | A | * | 3/1919 | Arrigoni | 5/617 |
| 1,422,405 | A | | 7/1922 | Alguire | |
| 1,818,598 | A | | 8/1931 | Berry | |
| 1,973,699 | A | | 9/1934 | Bradley | |
| 2,159,883 | A | * | 5/1939 | Caldwell | 5/604 |
| 2,202,383 | A | * | 5/1940 | Hymer et al. | 5/614 |
| 2,461,627 | A | | 2/1949 | Brewster | |
| 2,477,400 | A | | 7/1949 | Beem et al. | |
| 2,872,259 | A | | 2/1959 | Thorpe | |
| 3,753,592 | A | | 8/1973 | Jensen | |
| 4,277,858 | A | * | 7/1981 | Bohme | 5/618 |
| 4,376,316 | A | | 3/1983 | Mercier et al. | |
| 4,406,027 | A | | 9/1983 | Bourda | |
| 4,996,731 | A | | 3/1991 | Kruyt | |
| 5,040,253 | A | | 8/1991 | Cheng | |
| 5,060,636 | A | | 10/1991 | Bell | |

(Continued)

FOREIGN PATENT DOCUMENTS

| | | |
|---|---|---|
| DE | 42 30 013 | 3/1993 |

(Continued)

*Primary Examiner*—Sunil Singh
(74) *Attorney, Agent, or Firm*—Bose McKinney & Evans LLP

(57) ABSTRACT

A bed comprises a frame and a deck coupled to the frame. The deck includes a back section, a seat section, a thigh section, and a foot section. An actuator is coupled to the back section to move the back section from a horizontal position to an elevated position relative to the frame.

39 Claims, 12 Drawing Sheets

U.S. PATENT DOCUMENTS

| | | | | | |
|---|---|---|---|---|---|
| 5,109,554 | A | * | 5/1992 | Borders et al. | 5/602 |
| 5,127,034 | A | | 6/1992 | Wright | |
| 5,161,274 | A | * | 11/1992 | Hayes et al. | 5/618 |
| 5,261,725 | A | | 11/1993 | Rudolph | |
| 5,615,431 | A | | 4/1997 | Vassilli | |
| 5,640,730 | A | | 6/1997 | Godette | |
| 5,682,631 | A | | 11/1997 | Weismiller et al. | |
| 5,774,914 | A | | 7/1998 | Johnson et al. | |
| 5,778,467 | A | | 7/1998 | Scott et al. | |
| 5,790,997 | A | | 8/1998 | Ruehl | |
| 5,794,286 | A | | 8/1998 | Scott et al. | |
| 5,862,551 | A | | 1/1999 | Oguma et al. | |
| 5,906,017 | A | | 5/1999 | Ferrand et al. | |
| 6,012,186 | A | | 1/2000 | Soltani et al. | |
| 6,101,648 | A | | 8/2000 | Sommerfeld et al. | |
| 6,163,904 | A | * | 12/2000 | Royston | 5/618 |
| 6,347,420 | B1 | | 2/2002 | Elliott | |
| 2002/0178502 | A1 | * | 12/2002 | Beasley et al. | 5/618 |

FOREIGN PATENT DOCUMENTS

| | | |
|---|---|---|
| EP | 0 604 240 | 6/1994 |
| FR | 2 671 468 | 7/1992 |
| GB | 2362 566 | 11/2001 |

* cited by examiner

HOSPITAL BED

This application claims the benefit of U.S. provisional application Ser. No. 60/279,063 filed Mar. 27, 2001, the disclosure of which is expressly incorporated by reference herein.

BACKGROUND AND SUMMARY OF THE INVENTION

The present invention relates to an improved bed designs.

In one illustrated embodiment of the invention, a bed comprises a frame and a deck coupled to the frame. The deck is configured to support a mattress. The deck includes a first deck section and a movable second deck section. The bed also includes a flexible panel coupled to the first deck section. The flexible panel includes a portion positioned to overlap the movable second deck section during movement of the second deck section relative to the first deck section, thereby spanning a gap between the first deck section and the second deck section to support a portion of the mattress.

In the illustrated embodiment, the deck includes a movable third deck section located on an opposite side of the first deck section from the movable second deck section. The flexible panel includes a second portion configured to overlap the movable third deck section during movement of the third deck section relative to the first deck section, thereby spanning a gap between the movable third deck section and the first deck section to support a second portion of the mattress.

In one illustrated embodiment, the movable second deck section is a back section movable from a horizontal position to an elevated position relative to the frame, and the first deck section is a seat deck section. In another illustrated embodiment, the movable second deck section is a thigh deck section, and the first deck section is a seat deck section. The thigh deck section is movable relative to the seat deck section toward a foot end of the bed to increase a length of the thigh deck section.

In another illustrated embodiment, a bed comprises a frame having first and second spaced apart side frame members, a deck including a back section having first and second sides, and a first and second curved tubes coupled to the first and second sides of the back section, respectively, and a plurality of rollers coupled to the first and second side frame members. The rollers are configured to support the first and second curved tubes to permit movement of the curved tubes and the back section relative to the frame. The bed also comprises an actuator coupled to one of the back section and the first and second curved tubes to move the back section from a horizontal position to an elevated position relative to the frame.

In the illustrated embodiment, the first and second curved tubes have a radius centered at a pivot point located above the deck to emulate a natural hip pivot point of a person located on a mattress supported by the deck. Therefore, migration of the person toward a foot end of the bed when the back section is elevated is minimized. This reduces shear forces as applied to the person's skin and reduces staff requirements to reposition an immobile person that has migrated toward the foot end of the bed.

In yet another illustrated embodiment, a bed comprises a frame and a deck including a back section, a seat section, and a thigh section. The thigh section is movable to lengthen and shorten the thigh section. The bed also comprises an actuator coupled to the back section to move the back section from a horizontal position to an elevated position relative to the frame. The thigh section is lengthened in response to the back section moving from the horizontal position to the elevated position, and the thigh section is shortened in response to the back section moving from the elevated position to the horizontal position.

In one illustrated embodiment, an angle sensor is coupled to the back section and a second actuator coupled to the thigh section. The second actuator is configured to lengthen and shorten the thigh section in response to an output from the angle sensor.

In another illustrated embodiment, a mechanical linkage is coupled between the back section and the thigh section. The mechanical linkage is configured to lengthen and shorten the thigh section in response to movement of the back section.

In yet another embodiment, a second actuator is coupled to the thigh section to move the thigh section from a horizontal position to an elevated position relative to the frame. The thigh section includes a movable portion, and the second actuator is coupled to the movable portion. Illustratively, a track is coupled to the frame. The second actuator is coupled to the track for movement relative to the frame in response to movement of the back section, thereby moving the movable portion to lengthen and shorten the thigh section.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
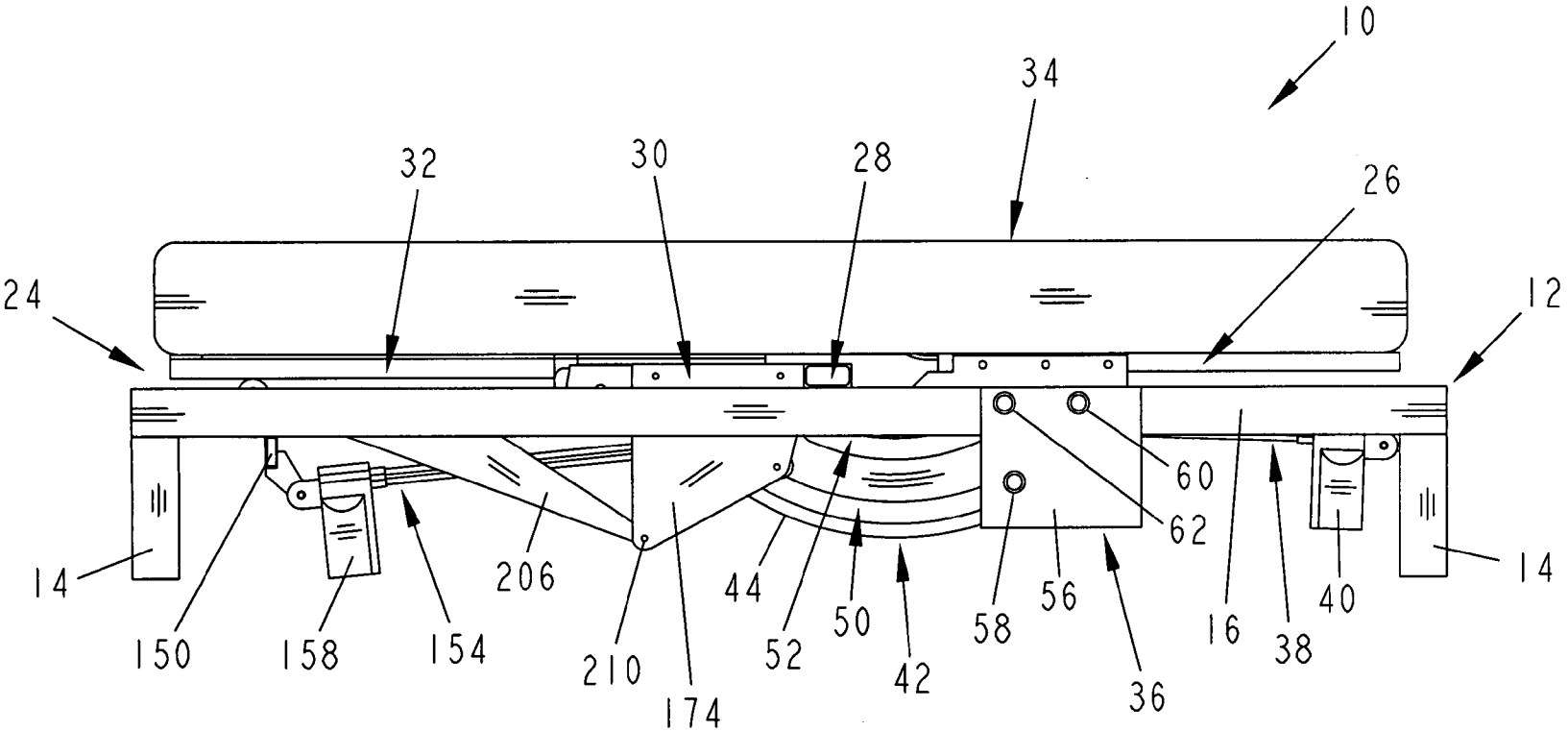
FIG. 1 is a side elevational view of a first embodiment of the present invention illustrating a first shearless pivot mechanism with a bed deck in a flat orientation.
Figure 2:
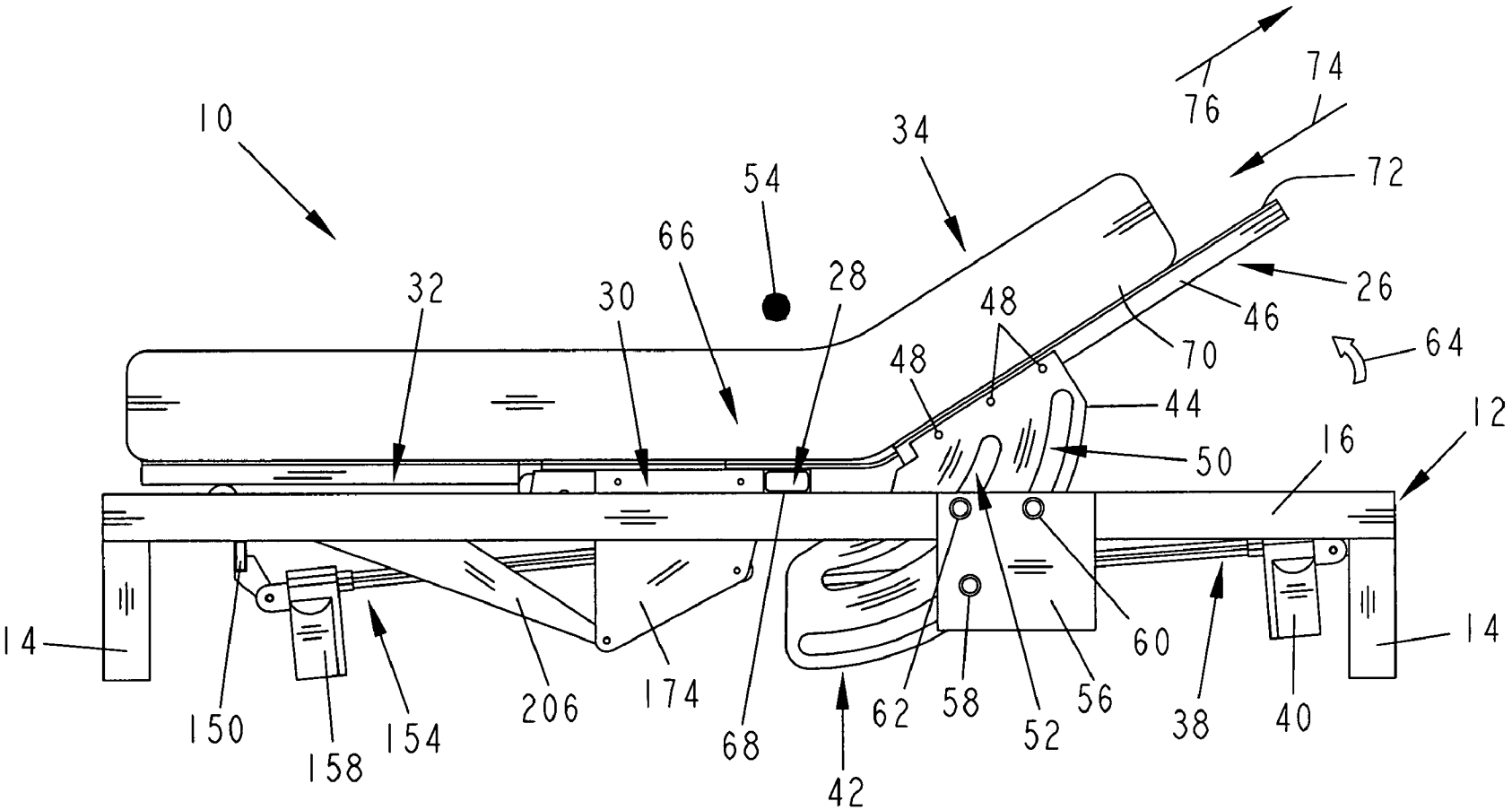
FIG. 2 is a side elevational view of the bed of FIG. 1 illustrating a back section of the bed deck moved to an elevated position.

Referring now to the drawings, FIGS. 1 and 2 illustrate a first embodiment of the present invention. A bed 10 includes a frame 12 which is illustratively supported by a plurality of legs 14. As illustrated in FIGS. 4–8, the frame 12 illustratively includes first and second spaced apart side frame sections 16 and 18, a head frame section 20, and a foot frame section 22. It is understood that the frame 12 may be mounted on any type of conventional bed base known in the art. Such a base typically includes a plurality of casters (not shown) for transporting the bed 10. An articulating deck 24 is coupled to the frame 12 as described in detail below. The articulating deck 24 includes a movable head or back section 26, a stationary seat section 28, a movable thigh section 30, and a movable foot section 32. The deck 24 supports a mattress 34.

Figure 3:
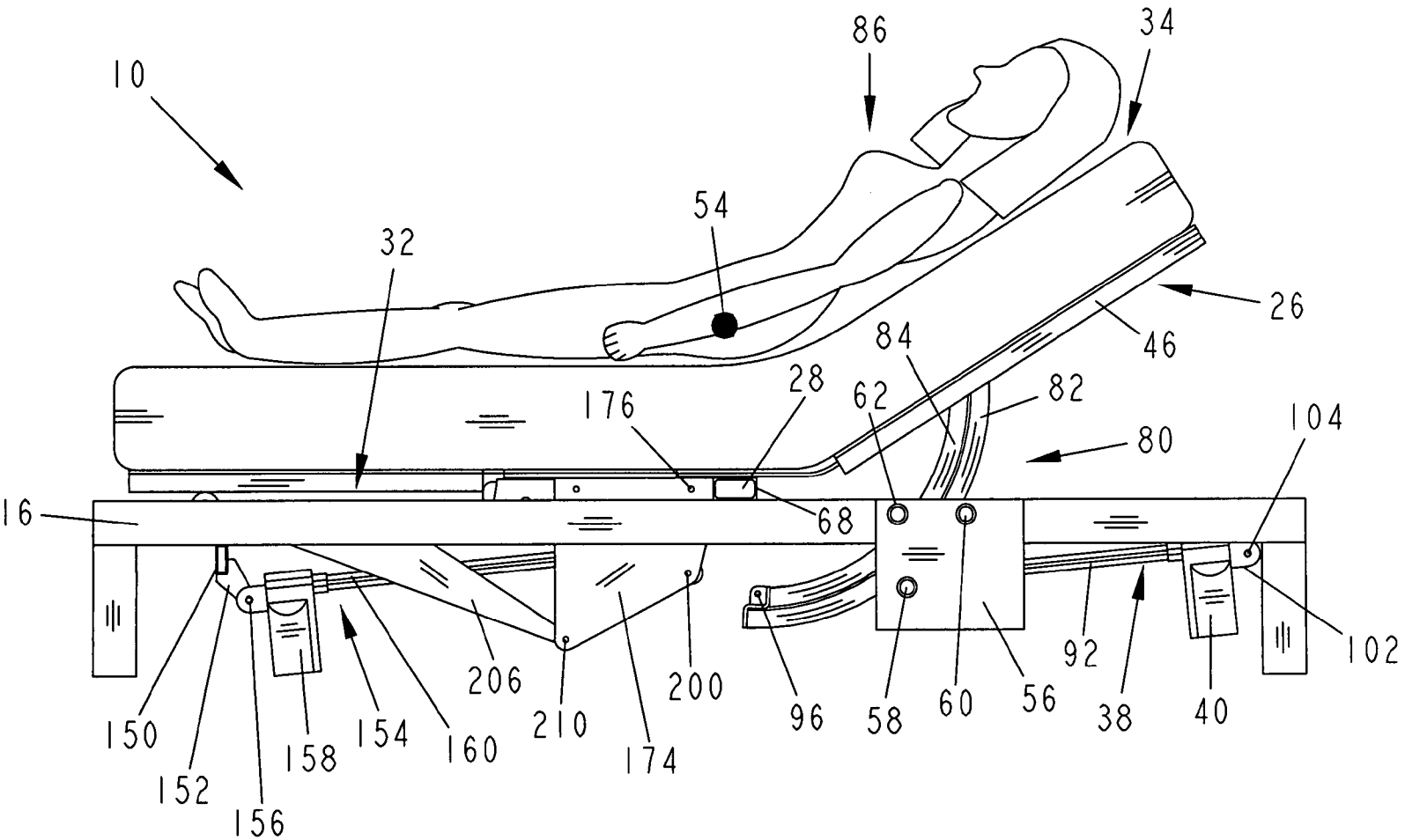
FIG. 3 is a side elevational view of another embodiment of the present invention illustrating a modified shearless pivot mechanism.

Movement of the back section 26 is controlled by a shearless pivot mechanism 36 which illustratively includes a linear actuator 38 having a drive motor 40. In the embodiment of FIGS. 1 and 2, mechanism 36 includes first and second spaced apart arcuate guides 42 located adjacent to first and second side frame members 16 and 18 of the bed 10. The arcuate guides 42 include plates 44 which are secured to side frame members 46 of back section 26 by suitable fasteners 48 or by other means such as welding as best shown in FIG. 2. The plates 44 are illustratively formed to include first and second arcuate slots 50 and 52. Slots 50 and 52 are curved about a radius centered at pivot point 54 which is located above the deck 24 and mattress 34 to emulate a natural hip pivot point of a person 86 located on the mattress 34 as best shown in FIG. 3.

A support 56 is coupled to each of the first and second side frame members 16 and 18. Rollers 58, 60, and 62 are rotatably coupled to supports 56. In the embodiment of FIGS. 1 and 2, two rollers 58 and 60 are illustratively located within outer slot 50, and one roller 62 is located within inner slot 52 to guide movement of the back section 26 from the flat, horizontal position shown in FIG. 1 to an elevated position shown in FIG. 2. Linear actuator 38 illustratively controls movement of the back section 26. When a piston 94 of the actuator 38 is extended as discussed below, the back section 26 moves to the horizontal position of FIG. 1. When the piston 94 of the actuator 38 is retracted, the back section 26 moves upwardly as indicated by arrow 64 in FIG. 2 to an elevated position.

In the illustrated embodiment, a seat portion 66 of mattress 34 is secured to the stationary seat section 28 of deck 24 by suitable fasteners such as straps 68. Straps 68 may include buckles, ties, or other fasteners to hold the mattress 34 to the seat section 38. It is understood that other types of fasteners such as Velcro, snaps, rivets, magnets, or the like may be used.

In another embodiment, a first fastener portion such as a dovetail groove track is mounted on the seat section 28. A second complementary fastener portion such as a dovetail member is mounted to a bottom surface 70 of mattress 34. In this illustrated embodiment, the mattress 34 is secured to the seat section 28 by sliding the second fastener portion on the mattress into the first fastener portion on the seat section 28.

The bottom surface 70 of mattress 34 is illustratively made from low friction material to promote sliding between the bottom surface 70 of mattress 34 and a deck panel 72 of back section 26. As the back section 26 moves from the horizontal position of FIG. 1 to the elevated position of FIG. 2, the mattress 34 slides on back panel 72 in the direction of arrow 74. When the back section 26 is returned to its horizontal position, the mattress 34 slides on panel 72 in the direction of arrow 76. Therefore, patient migration toward a foot end of the bed is minimized when the back section 26 is moved to an elevated position. This reduces shear forces applied to the patient's skin and reduces hospital staff requirements to reposition an immobile patient that has migrated toward the foot end of the bed.

Figure 4:
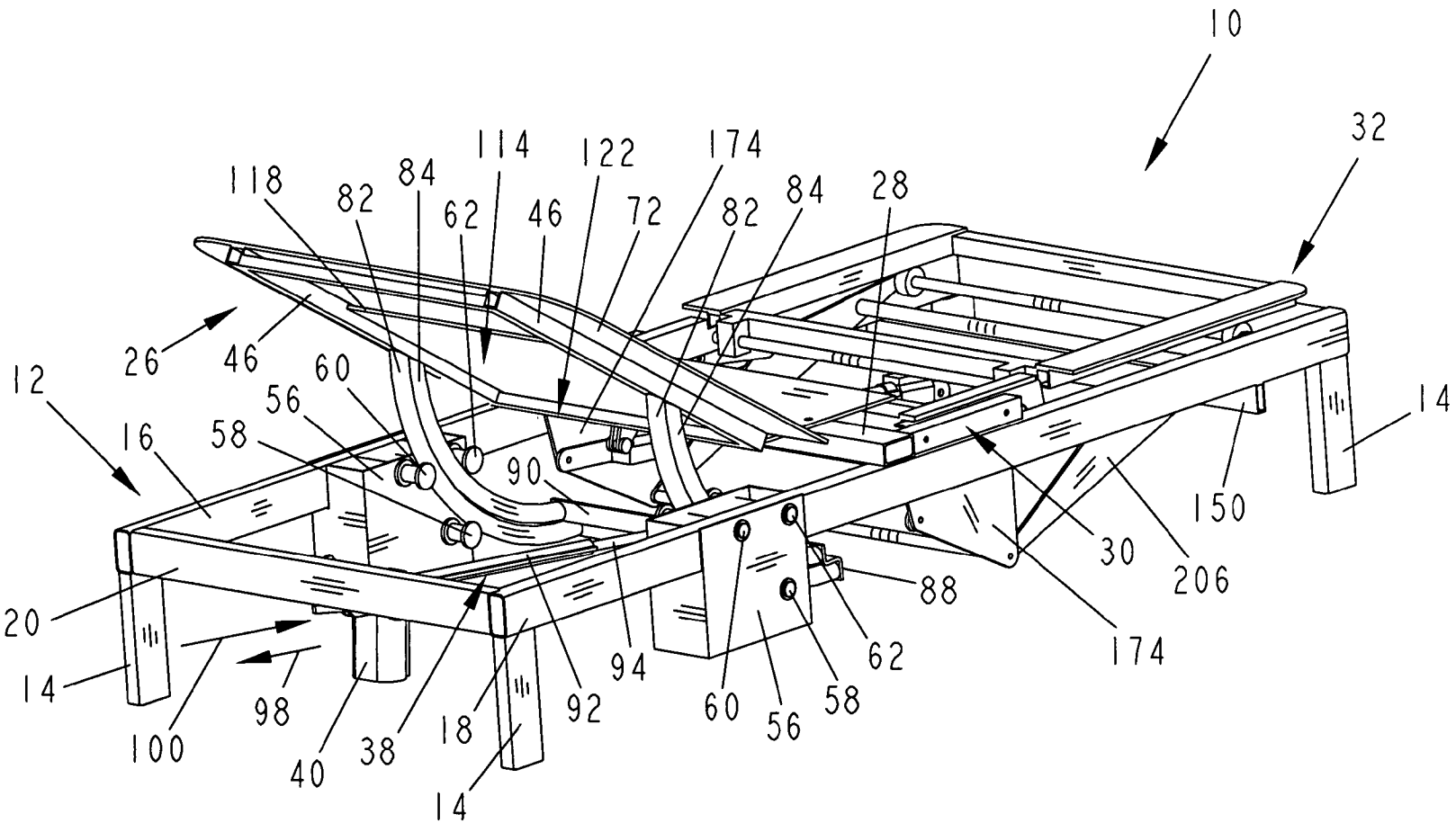
FIG. 4 is a perspective view illustrating details of the shearless pivot mechanism of the bed of FIG. 3.
Figure 5:
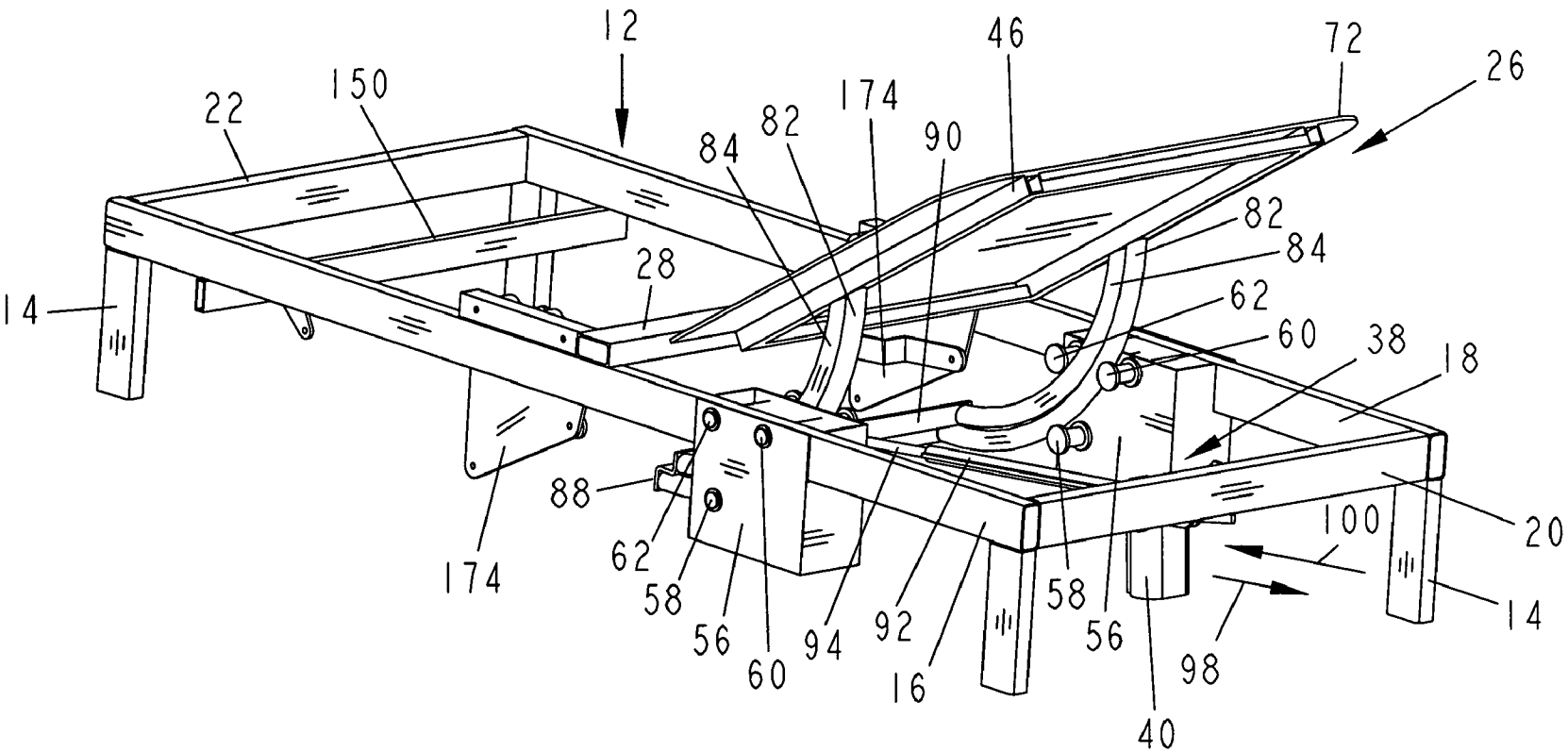
FIG. 5 is a perspective view of the bed of FIGS. 3 and 4 illustrating further details of the shearless pivot mechanism.

Another embodiment of the present invention is illustrated in FIGS. 3–5. Those elements referenced by numbers identical to FIGS. 1–2 perform the same or similar function. In the embodiment of FIGS. 3–5, a shearless pivot mechanism 80 includes first and second bent tubes 82 and 84 located adjacent each side frame member 16, 18. Tubes 82 and 84 are coupled to frame members 46 of back section 26 by welding or by suitable fasteners. Tubes 82 and 84 are arcuate members which have a radius centered at location 54 shown in FIG. 3 so that the pivoting back section 26 emulates the natural hip pivot of the person 86 on the mattress 34.

As best shown in FIGS. 4 and 5, the tubes 82 and 84 are secured between rollers 58 and 60 located on a bottom side of tube 82 and roller 62 located on a top side of tube 84. Also as shown in FIGS. 4 and 5, cross supports 88 and 90 extend between tubes 82 and 84, respectively, located on opposite sides of the bed 10 and adjacent the first and second side frame members 16 and 18. The linear actuator 38 includes a cylinder 92 and a movable piston 94 which is pivotably coupled to cross support 90 by a pivot connection 96 (see FIG. 3). As the piston 94 is retracted by motor 40 in the direction of arrow 98, back section 26 is pivoted upwardly to an elevated position. When piston 94 is extended in the direction of arrow 100, back section 26 moves from an elevated position to a flat, horizontal position similar to the position shown in FIG. 1.

In the illustrated embodiment, a head end of linear actuator 38 adjacent the motor 40 is pivotably coupled to a support bracket 102 by a pivot connection 104 as best shown in FIG. 3. Support bracket 102 is secured the head frame section 20. The shearless pivot mechanism 80 minimizes patient migration toward the foot end of the bed as back section 26 is elevated. As discussed above, this reduces shear forces on the patient's skin and reduces staff time required to reposition an immobile patient.

Figure 7:
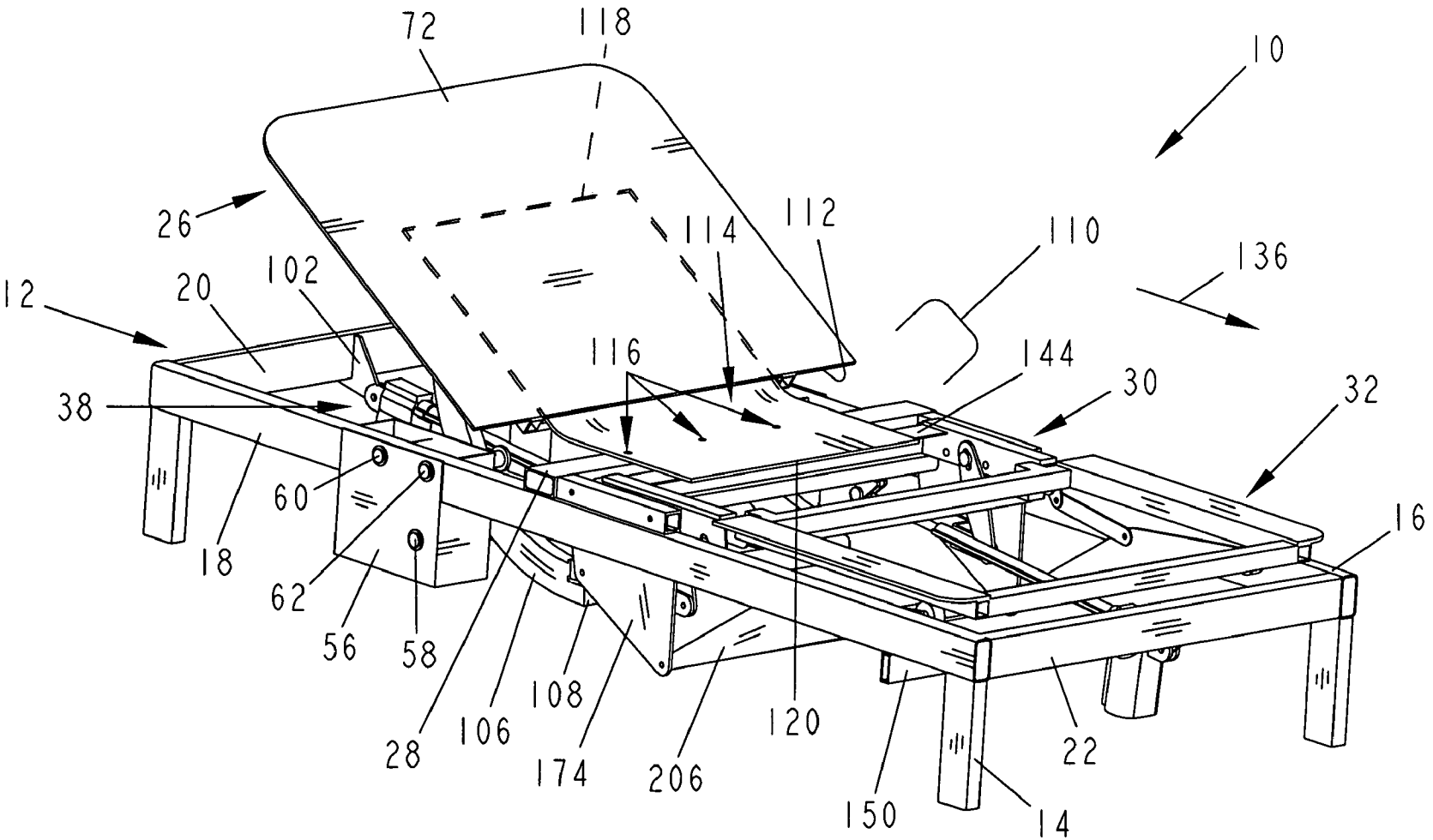
FIG. 7 is a perspective view of another embodiment of the present invention illustrating another embodiment of the shearless pivot mechanism.
Figure 8:
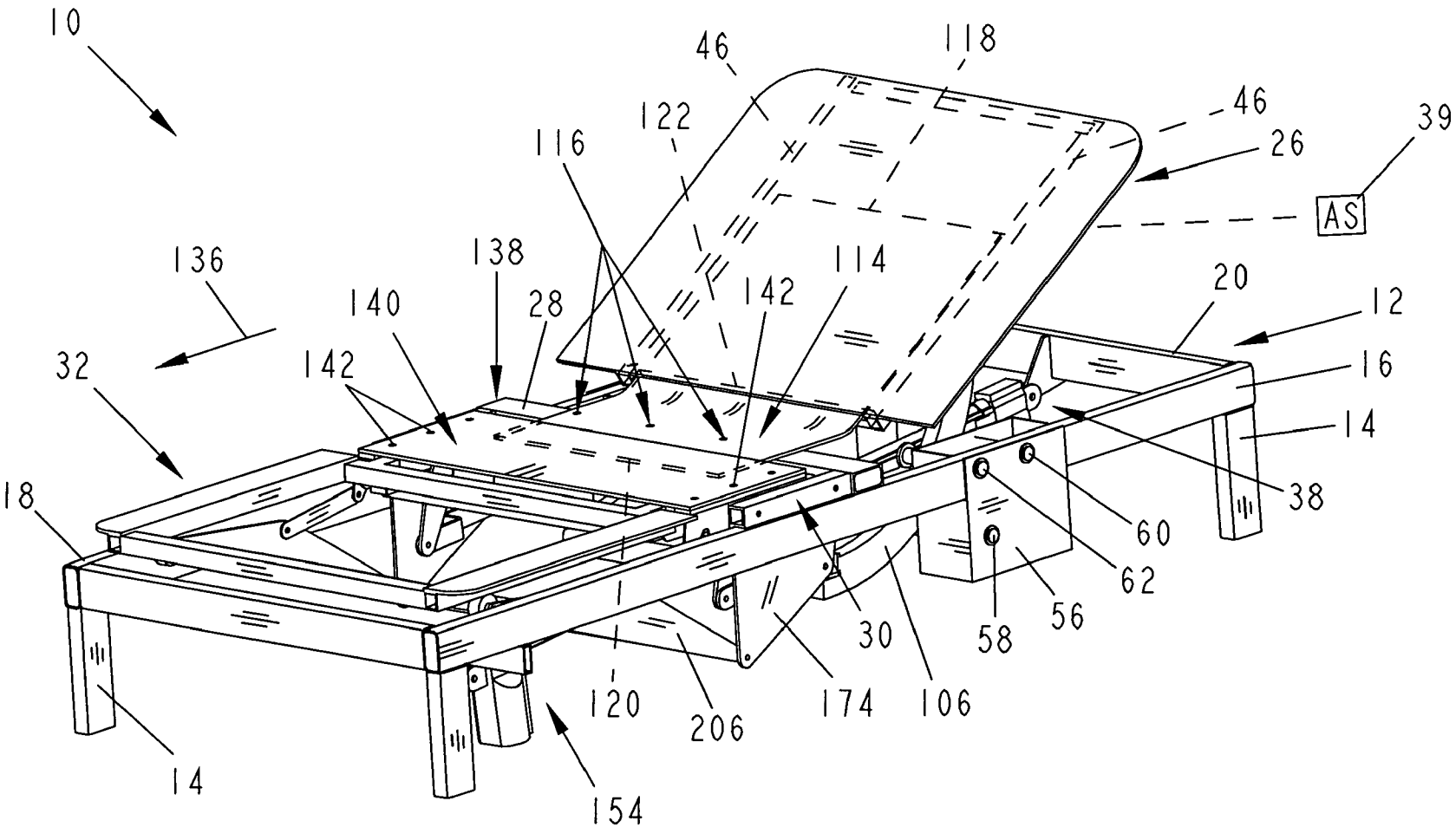
FIG. 8 is another perspective view of the embodiment of FIG. 7.

FIGS. 7 and 8 illustrate another embodiment of the present invention. In FIGS. 7 and 8, a single curved tube 106 is coupled to each side frame member 46 of the back section 26 by suitable fasteners or by welding. A single cross support member 108 extends between tubes 106 on opposite sides of the back section 26. Piston 94 is pivotably coupled to the cross member 108. Rollers 58 and 60 are located below tubes 106 and rollers 62 are located above tubes 106. Therefore, the shearless pivot mechanism of the present invention may be provided using arcuate guides 42 as shown in FIGS. 1 and 2, multiple curved tubes as shown in FIGS. 3–5, or a single curve tube as shown in FIGS. 7 and 8. Other components of the shearless pivot mechanism shown in FIGS. 7 and 8 operate as described above.

As the back section 26 is moved from a horizontal position to an elevated position, a gap 110 is created between the stationary seat section 28 and a foot end 112 of the back section 26 as best shown in FIGS. 7 and 8. A flexible panel 114 is secured to the stationary deck section 28 by suitable fasteners 116 such as bolts, screws, rivets, welding, Velcro material, magnets, or the like. Panel 114 includes a head end 118 and a foot end 120 which extend away from the seat deck section 28.

Figure 9:
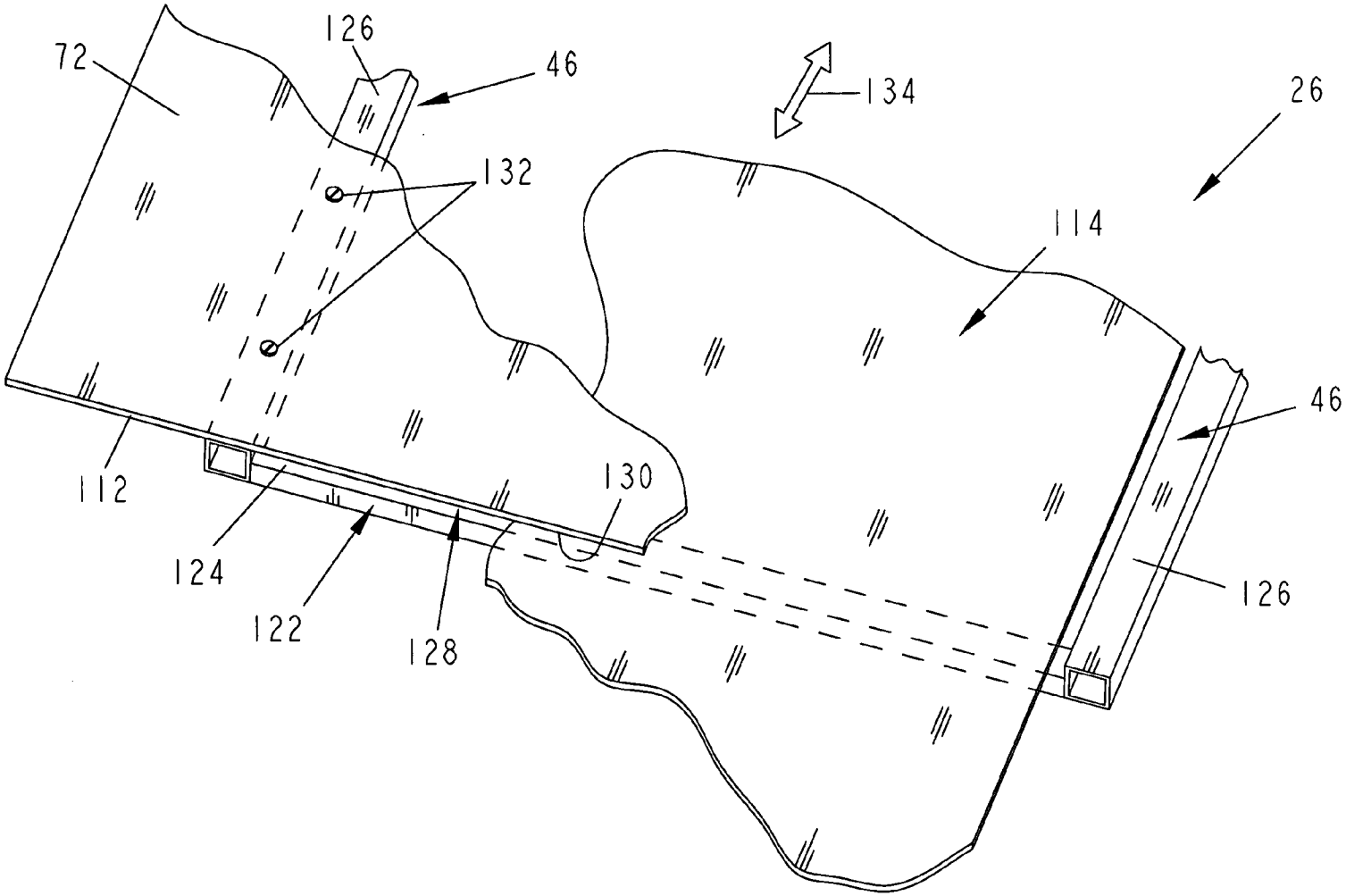
FIG. 9 is an enlarged view of a portion of the bed of FIGS. 1–8 illustrating a flexible panel which is configured to close a gap between a seat section of the bed deck and a back section of the bed deck as the back section of the bed deck articulates.

The flexible panel 114 extends under the panel 72 of back section 26 as best illustrated in FIG. 9. FIG. 9 illustrates the spaced apart side frame members 46 of back section 26. A cross frame member 122 is coupled between side frame members 46 adjacent a foot end 112 of back section 26. A top surface 124 of cross member 122 is spaced downwardly below top surfaces 126 of side frame members 46 to create a slot 128 between the top surface 124 of cross member 122 and a bottom surface 130 of deck panel 72. Illustratively, deck panel 72 is coupled to the side frame members 46 by suitable fasteners 132. The flexible panel 114 extends through the slot 128. The flexible panel 114 moves back and forth within the slot 128 and relative to back section 26 in the directions of double headed arrow 134 as the back section 26 articulates. Therefore, the panel 114 covers the gap 110.

The foot end portion 120 of flexible panel 114 extends toward the foot end of the bed to overlap a portion of the thigh section 30 of deck 24. As discussed in detail below, a portion of the thigh deck section 30 moves toward the foot end of the bed 10 in the direction of arrow 136 in FIGS. 7 and 8 as the thigh deck section 30 and foot deck section 32 are elevated. Alternatively, the thigh section 30 and foot section 32 move in the direction of arrow 136 when the back section 26 is elevated as discussed below with reference to FIGS. 11 and 12.

When the thigh section 30 moves in the direction of arrow 136 a gap 138 is created between the stationary seat section 28 and the thigh section 30. The foot end 120 of panel 114 extends under a deck panel 140 secured to thigh section 30 by fasteners 142 as shown in FIG. 8 in a manner similar to the manner discussed above. Panel 114 extends into a slot formed between the deck panel 140 and a cross support 144 as best shown in FIG. 7. Therefore, the flexible panel 114 fills in the gaps 110, 138 created between the stationary seat section 28 and the articulating back and thigh sections 26 and 30, respectively, as the deck 24 articulates. Panel 114 prevents the mattress 34 from falling into the gaps 110, 138.

Back section 26 and thigh section 30 slide relative to the ends 118 and 120, respectively, of panel 114. The panel 114 bends as the back section 26 and thigh section 30 are articulated. The head end 118 of panel 114 remains substantially coplanar with the back section 26 and the foot end 120 of panel 114 remains substantially coplanar with the thigh section 130 during deck articulation. The panel 114 is illustratively made from a plastic material but, it is understood that the panel 114 may be made from any suitable flexible material.

Figure 6:
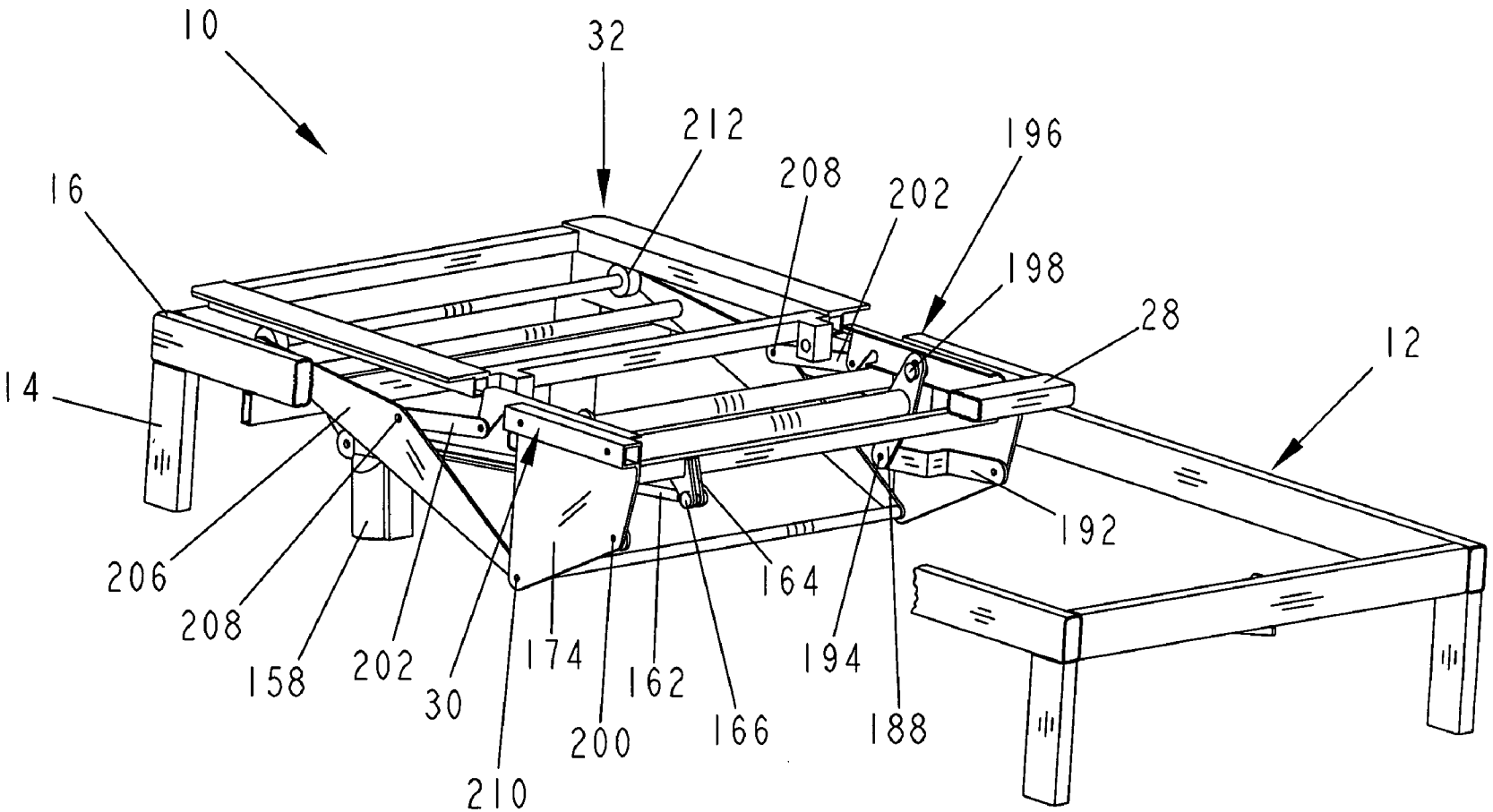
FIG. 6 is a perspective view illustrating one embodiment of an expandable length thigh deck section coupled to a foot deck section.
Figure 10:
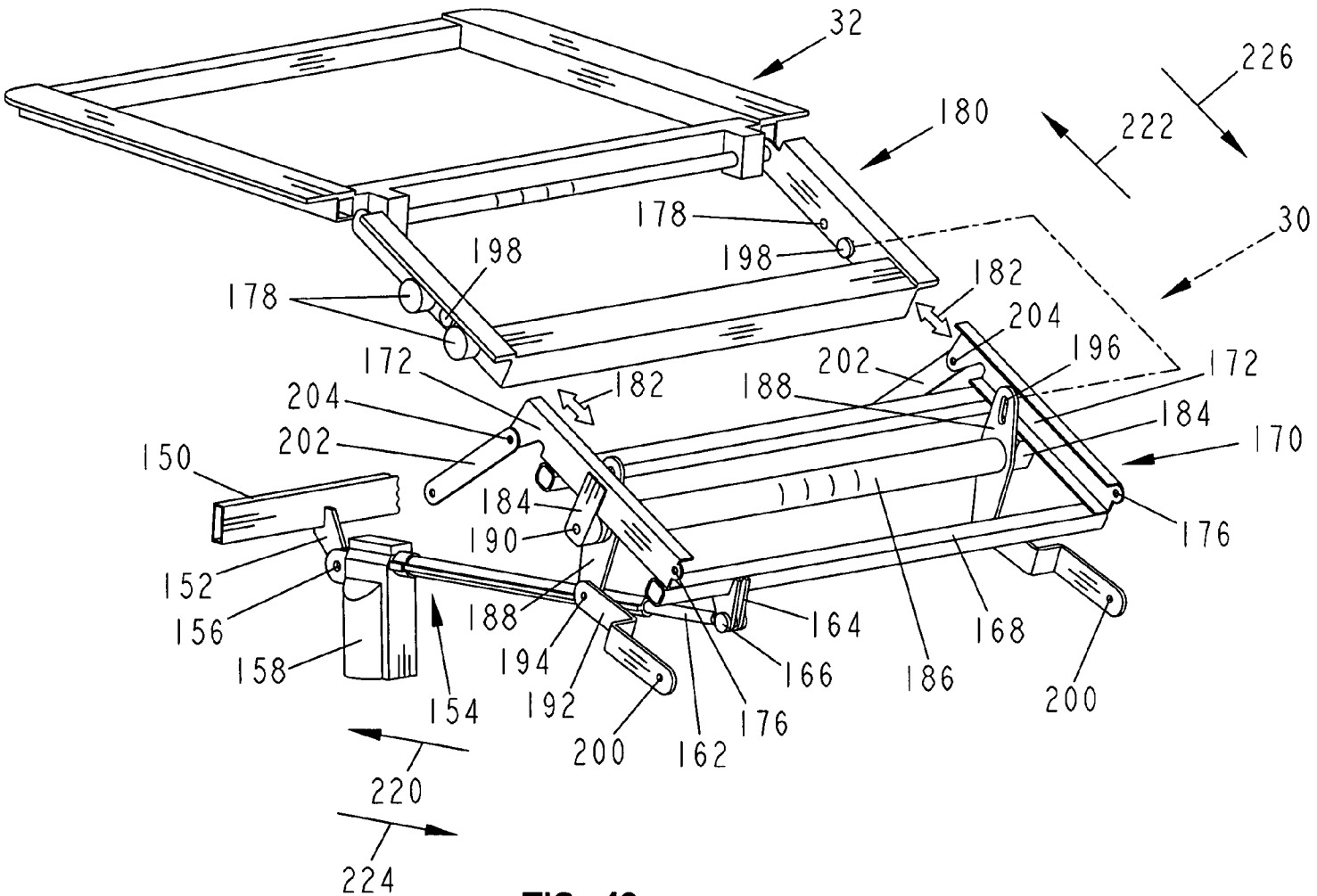
FIG. 10 is an exploded perspective view of the expandable thigh section of the bed deck of the present invention.

The thigh deck section 30 and foot deck section 32 are best illustrated in FIGS. 6 and 10. A cross support 150 extends between side frame members 16 and 18 support bracket 152 is coupled to cross member 150. A first end of a linear actuator 154 is pivotably coupled to bracket 152 by pivot connection 156. Linear actuator includes a motor 158, a cylinder 160, and a movable piston 162 to distal end of piston 162 is pivotably coupled to a bracket 164 by pivot connection 166. Bracket 164 is coupled to a cross member 168 of a stationary frame 170 of thigh deck section 30.

Stationary frame 170 includes spaced apart side frame members 172 which are pivotably coupled to side supports 174 by pivot connections 176. A side support 174 is coupled to each side frame member 16, 18. Illustratively, side frame members 172 are U-shaped channels configured to receive rollers 178 on a movable frame 180 of thigh section 30. Movable frame 180 slides back and forth relative to stationary frame 170 in the direction of double headed arrows 182 in FIG. 10.

Supports 184 are coupled to each of the side frame members 172 of fixed frame 170. A cylinder 186 and levers 188 are pivotably coupled to brackets 184 by pivot connections 190. Arms 192 are pivotably coupled to one end of levers 188 by pivot connection 194. Second ends 196 of levers 188 are pivotably coupled to movable frame 180 at locations 198. An opposite end of arms 192 is coupled to a respective support 174 by pivot connections 200 as best shown in FIG. 6. Arms 202 have a first end coupled to fixed frame 170 by pivot connection 204. An opposite end of arms 202 is coupled to triangular shaped plate 206 by pivot connection 208. One corner of plate 206 is pivotably coupled to bracket 174 at location 210. Another corner of each plate 206 is rotatably coupled to a roller 212 which is movable relative to foot section 32.

In operation, when the piston 162 is retracted in the direction of arrow 220 in FIG. 10, fixed frame 170 pivots upwardly and lever 188 is rotated in a counter clockwise direction to move movable frame 180 in the direction of arrow 222 to extend or lengthen the thigh section 30 as frame 170 is elevated. Therefore, movement of piston 162 in the direction of arrow 220 causes the stationary frame 170 to pivot upwardly about pivot connections 176 to an upwardly extended "knee gatch" position. When the piston 162 is extended in the direction of arrow 224, frame 170 pivots downwardly and lever 188 is rotated in a clockwise direction to retract movable frame 180 in the direction of arrow 226, thereby shortening the overall length of thigh section 30.

In another embodiment of the present invention, a linear actuator (not shown) or other drive mechanism is coupled to movable frame 180 or to levers 188 so that the thigh section 30 is selectively lengthened and shortened whether or not the thigh section is elevated. In this embodiment, a conventional back section angle sensor 39 is configured to detect an angle of elevation of the back section 26. As the back section 26 is elevated, the thigh section 30 is lengthened using the linear actuator (not shown). When the back section 26 is elevated, the person's legs typically move about 2–4 inches toward the foot end of the bed. By lengthening the thigh section 30 as the back section 26 is elevated whether or not the thigh section 30 is elevated, the present invention reduces migration of the person 86 toward the foot end of the bed 10 and reduces shear forces on the person's skin. Alternatively, the seat section 28 may include a movable portion coupled to the linear actuator. As the back section sensor 39 detects upward movement of the back section, the seat section is lengthened by moving the movable seat section toward a foot end of the bed by up to about four inches.

Figure 11:
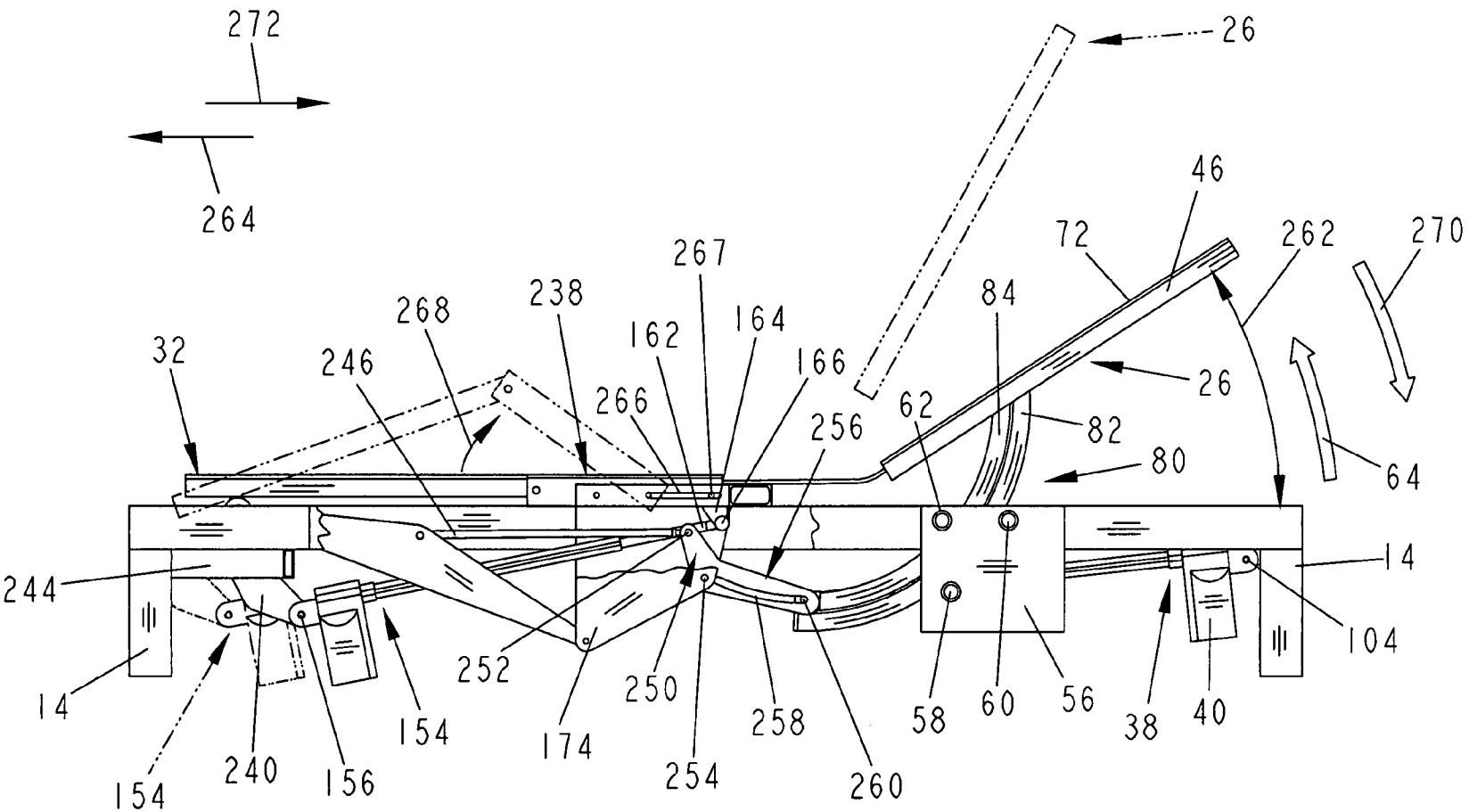
FIG. 11 is a side elevational view of another embodiment of an expanding thigh section of a bed deck in accordance with the present invention.
Figure 12:
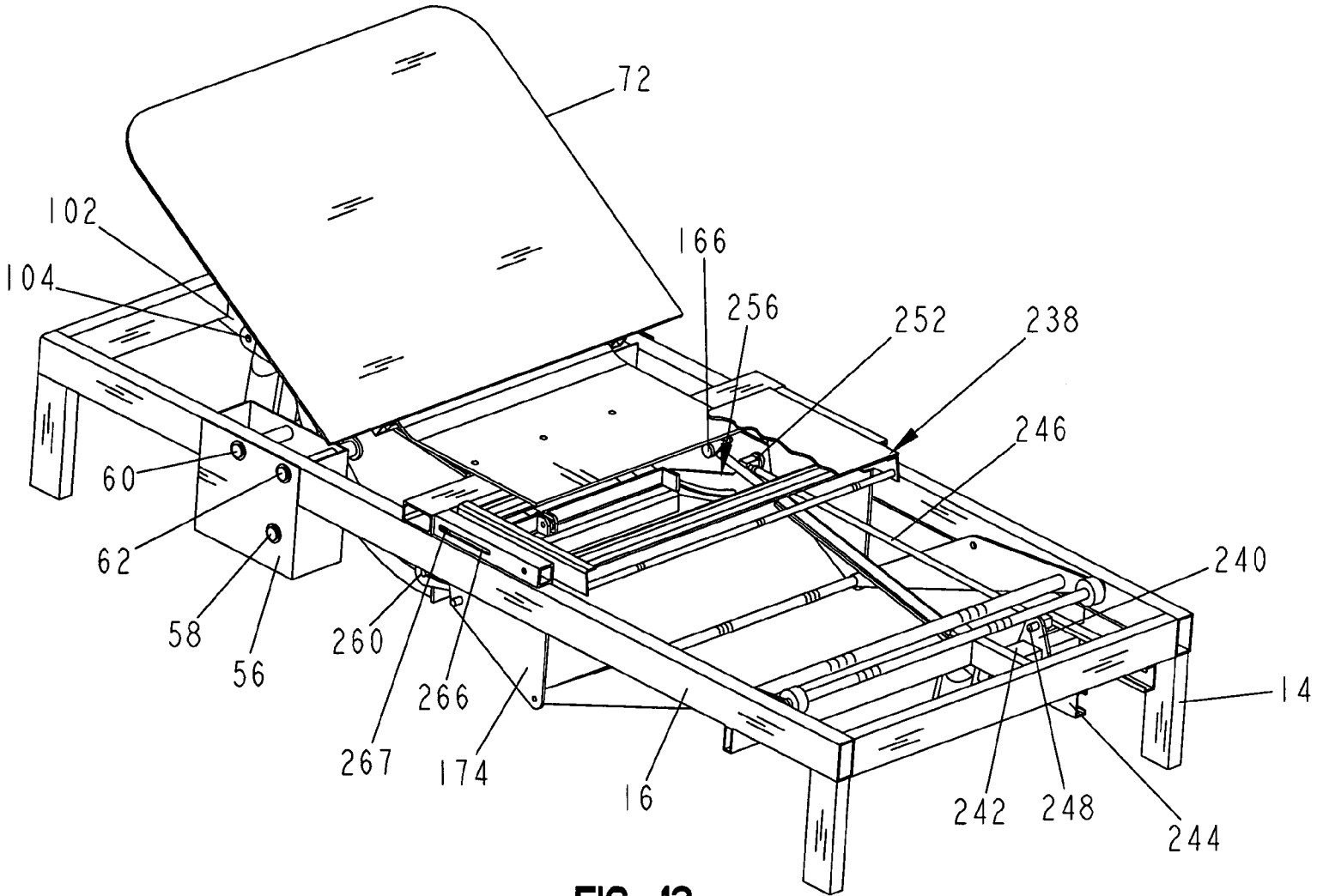
FIG. 12 is another perspective view of the embodiment illustrated in FIG. 11.

Another embodiment of the present invention is illustrated in FIGS. 11 and 12. Those elements referenced by numbers identical to FIGS. 1–10 perform the same or similar function. In the embodiment of FIGS. 11 and 12, a mechanical linkage is provided between a movable frame 238 of thigh section 30 and the back section 26 of bed 10. Therefore, as the back section 26 is elevated, the mechanical linkage automatically increases the length of thigh section 30.

In the embodiment of FIGS. 11 and 12, a first end of linear actuator 154 is coupled to a lower end of a bracket 240 by pivot connection 156. Bracket 240 is coupled to a movable frame 242 which slides back and forth within a track 244. Track 244 illustratively includes a pair of opposing U-shaped channels. However, it is understood that any suitable guide track may be used. A connecting link 246 is coupled to an upper end of bracket 240 at location 248. An opposite end of connecting link 246 is pivotably coupled to one arm of a generally L-shaped link 250 by pivot connection 252. A central portion of L-shaped link 250 is pivotably coupled to supports 174 by pivot connection 254. A second arm 256 of link 250 is formed to include an elongated slot 258. Slot 258 is illustratively curved to match the curve of tubes 82, 84. A pin 260 coupled to tubes 82, 84 of back section 26 is located within the elongated slot 258. The end of piston 162 of linear actuator 154 is pivotably coupled to bracket 164 by pivot connection 166. In the embodiment of FIGS. 11 and 12, bracket 164 is coupled to movable frame 238.

In operation, as the back section 26 moves upwardly in the direction of arrow 64, pin 260 initially moves slot 258 until back section 26 is pivoted upwardly at an angle of about 25–35 degrees as illustrated by angle 262 in FIG. 11. Further movement of back section 26 in the direction of arrow 64 causes L-shaped link 250 to pivot in a counterclockwise direction about pivot connection 254 which, in turn, causes connecting link 246 to move in the direction of arrow 264. Movement of connecting link 246 in the direction of arrow 264 causes movable frame 242 to move in the direction of arrow 264 within track 244. Therefore, the linear actuator 154 and movable frame 238 coupled to bracket 164 also move in the direction of arrow 264 (as shown in phantom lines in FIG. 11) as the back section 26 moves upwardly to the position shown in phantom lines in FIG. 11.

Movable frame 238 illustratively includes portions such as pins 267 which slide in slots 266 formed in brackets 174. Since the piston 162 of linear actuator 154 is coupled to movable frame 238 by bracket 164, movable frame 238 can be pivoted upwardly in the direction of arrow 268 to elevate the thigh section 30 by retracting piston 162 as shown in phantom lines in FIG. 11. Illustratively, the movable frame 238 is configured to move about four inches in the direction of arrow 264 as the head section is elevated to its maximum angle. As back section 26 is lowered from an elevated position to a flat position in the direction of arrow 270, link 250 is pivoted in a clockwise direction to move connecting link 246 in the direction of arrow 272. This movement causes the movable frame 242, the linear actuator 154, and the movable frame 238 to move in the direction arrow 272 back to the positions shown in solid lines in FIG. 11.

Although the invention has been described in detail with reference to certain illustrated embodiments, variations and modifications exist within the scope and spirit of the invention as described and as defined in the following claims.

What is claimed is:

1. A bed comprising:

a frame having first and second spaced apart side frame members;

a deck including a back section having first and second sides, a seat section located adjacent the back section and a thigh section located adjacent the seat section, the thigh section being movable relative to the seat section toward a foot end of the bed, wherein the thigh section is movable to increase a length of the thigh section as the thigh section is elevated relative to the frame;

a first and second curved tubes coupled to the first and second sides of the back section, respectively;

a plurality of rollers coupled to the first and second side frame members, the plurality of rollers being configured to support the first and second curved tubes to permit movement of the curved tubes and the back section relative to the frame; and an actuator disposed beneath the back section and coupled to one of the back section and the first and second curved tubes to move the back section from a horizontal position to an elevated position relative to the frame.

2. The bed of claim 1, wherein the first and second curved tubes have a radius centered at a pivot point located above the deck.

3. The bed of claim 1, wherein a pair of first curved tubes are coupled to the first side of the back section and a pair of second curved tubes are coupled to the second side of the back section.

4. The bed of claim 1, wherein the first and second curved tubes have a square cross sectional shape.

5. The bed of claim 1, wherein the first and second curved tubes have a round cross sectional shape.

6. The bed of claim 1, further comprising a flexible panel coupled to the seat section, the flexible panel including a portion positioned to overlap the back section and to move relative thereto during movement of the back section relative to the frame, thereby spanning a gap between the back section and the seat section to support a mattress.

7. The bed of claim 6, wherein the seat section is fixed to the frame.

8. The bed of claim 1, further comprising a mattress located on the deck, the mattress being coupled to the seat section so that the back section slides relative to the mattress as the back section moves relative to the frame.

9. The bed of claim 1, further comprising a flexible panel coupled to the seat section, the flexible panel including a portion spanning a gap between the back section and the seat section to support a mattress.

10. The bed of claim 9, wherein the back section includes a panel to cover a portion of the flexible panel.

11. The bed of claim 10, wherein the back section includes a cross member defining a slot between the cross member and the panel to receive the flexible panel.

12. A bed comprising:

a frame having first and second spaced apart side frame members;

a deck including a back section having first and second sides;

a first and second curved tubes coupled to the first and second sides of the back section, respectively;

a plurality of rollers coupled to the first and second side frame members, the plurality of rollers being configured to support the first and second curved tubes to permit movement of the curved tubes and the back section relative to the frame; and an actuator disposed beneath the back section and coupled to one of the back section and the first and second curved tubes to move the back section from a horizontal position to an elevated position relative to the frame, wherein a thigh section is movable to increase a length of the thigh section when the thigh section is not elevated in response to movement of the back section from the horizontal position to the elevated position.

13. The bed of claim 12, further comprising an angle sensor coupled to the back section and an actuator coupled to the thigh section, the actuator being configured to lengthen and shorten the thigh section in response to an output from the angle sensor.

14. A bed frame comprising:

first and second spaced apart side frame members;

a deck configured to support a mattress, the deck including a back section having first and second sides, a seat section located adjacent the back section and a thigh section located adjacent the seat section, the thigh section being located adjacent the seat section, the thigh section being movable relative to the seat deck section toward a foot end of the bed, wherein the thigh section is movable to increase a length of the thigh section as the thigh section is elevated relative to frame;

first and second curved tubes coupled to the first and second sides of the back section, respectively;

a plurality of rollers coupled to the first and second side frame members, the plurality of rollers being configured to support the first and second curved tubes to permit movement of the curved tubes and the back section relative to the frame; and an actuator disposed beneath the back section and coupled to one of the back section and the first and second curved tubes to move the back section from a horizontal position to an elevated position relative to the frame.

15. The bed frame of claim 14, wherein the first and second curved tubes have a radius centered at a pivot point located above the deck.

16. The bed frame of claim 14, wherein a pair of first curved tubes are coupled to the first side of the back section and a pair of second curved tubes are coupled to the second side of the back section.

17. The bed frame of claim 14, wherein the first and second curved tubes have a square cross sectional shape.

18. The bed frame of claim 14, wherein the first and second curved tubes have a round cross sectional shape.

19. The bed frame of claim 14, further comprising a flexible panel coupled to the seat section, the flexible panel including a portion positioned to overlap the back section and to move relative thereto during movement of the back section relative to the frame, thereby spanning a gap between the back section and the seat section to support a mattress.

20. The bed frame of claim 19, wherein the seat section is fixed to the frame.

21. The bed frame of claim 19, further comprising a mattress fastener, the mattress fastener being coupled to the seat section to secure the mattress thereto.

22. The bed frame of claim 14, further comprising a flexible panel coupled to the seat section, the flexible panel including a portion spanning a gap between the back section and the seat section to support the mattress.

23. The bed frame of claim 22, wherein the back section includes a panel to cover a portion of the flexible panel.

24. The bed frame of claim 23, wherein the back section includes a cross member defining a slot between the cross member and the panel to receive the flexible panel.

25. A bed frame comprising:

first and second spaced apart side frame members;

a deck configured to support a mattress, the deck including a back section having first and second sides;

first and second curved tubes coupled to the first and second sides of the back section, respectively;

a plurality of rollers coupled to the first and second side frame members, the plurality of rollers being configured to support the first and second curved tubes to permit movement of the curved tubes and the back section relative to the frame; and an actuator disposed beneath the back section and coupled to one of the back section and the first and second curved tubes to move the back section from a horizontal position to an elevated position relative to the frame, wherein a thigh section is movable to increase a length of the thigh section in response to movement of the back section from the horizontal position to the elevated position.

26. The bed frame of claim 25, further comprising an angle sensor coupled to the back section and an actuator coupled to the thigh section, the actuator being configured to lengthen and shorten the thigh section in response to an output from the angle sensor.

27. A bed frame comprising:

first and second spaced apart side frame members;

a deck including a back section having first and second sides;

a first and second curved tubes coupled to the first and second sides of the back section, respectively;

a plurality of rollers coupled to the first and second side frame members, the plurality of rollers being configured to support the first and second curved tubes to permit movement of the curved tubes and the back section relative to the frame; and a linear actuator disposed beneath the back section and coupled to one of the back section and the first and second curved tubes to move the back section from a horizontal position to an elevated position relative to the frame, and to move the back section from an elevated position to a horizontal position relative to the frame.

28. The bed of claim 27, further comprising a cross member having a first end coupled to the first tube and a second end coupled to a second tube, the linear actuator being coupled to the cross member to move the back section between the horizontal position and the elevated position.

29. The bed of claim 28, wherein the linear actuator includes a piston movable from an extended position to a retracted position, an end of the piston being pivotably coupled to the cross member.

30. The bed frame of claim 27, wherein the first and second curved tubes have a radius centered at a pivot point located above the deck.

31. The bed frame of claim 27, wherein a pair of first curved tubes are coupled to the first side of the back section and a pair of second curved tubes are coupled to the second side of the back section.

32. The bed frame of claim 27, wherein the first and second curved tubes have a square cross sectional shape.

33. The bed frame of claim 27, wherein the first and second curved tubes have a round cross sectional shape.

34. The bed frame of claim 27, wherein the deck includes a seat section located adjacent the back section, and further comprising a flexible panel coupled to the seat section, the flexible panel including a portion positioned to overlap the back section and to move relative thereto during movement of the back section relative to the frame, thereby spanning a gap between the back section and the seat section to support a mattress.

35. The bed frame of claim 34, wherein the seat section is fixed to the frame.

36. The bed frame of claim 34, further comprising a mattress fastener, the mattress fastener being coupled to the seat section to secure the mattress thereto.

37. A bed frame comprising:

first and second spaced apart side frame members;

a deck configured to support a mattress, the deck including a back section having first and second sides;

first and second curved tubes coupled to the first and second sides of the back section, respectively;

a plurality of rollers coupled to the first and second side frame members, the plurality of rollers being configured to support the first and second curved tubes to permit movement of the curved tubes and the back section relative to the frame; and a linear actuator disposed beneath the back section and coupled to one of the back section and the first and second curved tubes to move the back section from a horizontal position to an elevated position relative to the frame, and to move the back section from an elevated position to a horizontal position relative to the frame.

38. The bed frame of claim 37, further comprising a cross member having a first end coupled to the first tube and a second end coupled to the second tube, the linear actuator being coupled to the cross member to move the back section between the horizontal position and the elevated position.

39. The bed frame of claim 38, wherein the linear actuator includes a piston movable from an extended position to a retracted position, an end of the piston being pivotably coupled to the cross member.

* * * * *